US005630743A

United States Patent [19]

Shi

[11] Patent Number: 5,630,743

[45] Date of Patent: May 20, 1997

[54] PHOTOSENSITIVE ELECTRIC TOY CAR

[76] Inventor: Show Li Shi, P.O. Box 82-144, Taipei, Taiwan

[21] Appl. No.: 629,087

[22] Filed: Apr. 8, 1996

[51] Int. Cl.[6] ..... A63H 17/36

[52] U.S. Cl. ..... 446/175; 446/460; 446/462

[58] Field of Search ..... 446/175, 444, 446/460, 462

[56] References Cited

U.S. PATENT DOCUMENTS

| | | | |
|---|---|---|---|
| 2,331,144 | 7/1943 | Sitter | 446/175 |
| 3,130,803 | 4/1964 | Wiggins | 446/175 |
| 3,849,931 | 11/1974 | Gulley, Jr. | 446/175 |
| 4,086,724 | 5/1978 | McCaslin | 446/175 |

FOREIGN PATENT DOCUMENTS

| | | | |
|---|---|---|---|
| 729375 | 12/1966 | Italy | 446/175 |

*Primary Examiner*—Robert A. Hafer

*Assistant Examiner*—Jeffrey D. Carlson

[57] ABSTRACT

A photosensitive electric toy car including a base provided with a pair of front wheels at a front portion thereof and a pair of rear wheels at a rear portion thereof, a power chamber fitted on an opening of the base, a control device arranged within the power chamber and provided two photosensitive resistors which will pick up signal from ground to control rotating direction of a first motor, a battery chamber electrically connected with the control device, a driven plate mounted on the top of the power chamber, a cover plate mounted on the top of a curved member on the base, and a driving device for controlling a second motor to drive the toy car, whereby the toy car can be conveniently controlled to move along a desired path.

1 Claim, 9 Drawing Sheets

PHOTOSENSITIVE ELECTRIC TOY CAR

BACKGROUND OF THE INVENTION

1. Field of the Invention

This invention relates to an electric toy car which utilizes a photosensitive resistor to control the driving motor.

2. Description of the Prior Art

It has been found that the conventional electric toy cars are too monotonous to attract one's attention. Furthermore, some of the electric toy cars will turn their direction when colliding with an object thereby attracting children to chase after the cars and therefore often tripping and hurting the children, and some of them must be played in a relatively large place thus causing much inconvenience.

Therefore, it is an object of the present invention to provide a photosensitive electric toy car which can obviate and mitigate the above-mentioned drawbacks.

SUMMARY OF THE INVENTION

This invention is concerned with a photosensitive electric toy car.

It is the primary object of the present invention to provide a photosensitive electric toy car which utilizes a photosensitive control system to control the driving motor.

It is another object of the present invention to provide a photosensitive electric toy car which will not cause a child to trip.

It is still another object of the present invention to provide a photosensitive electric toy car which can arouse interest and cause fun.

It is still another object of the present invention to provide a photosensitive electric toy car which can be controlled to go along a desired path.

It is a further object of the present invention to provide a photosensitive electric toy car which can be placed at the market at a low price.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
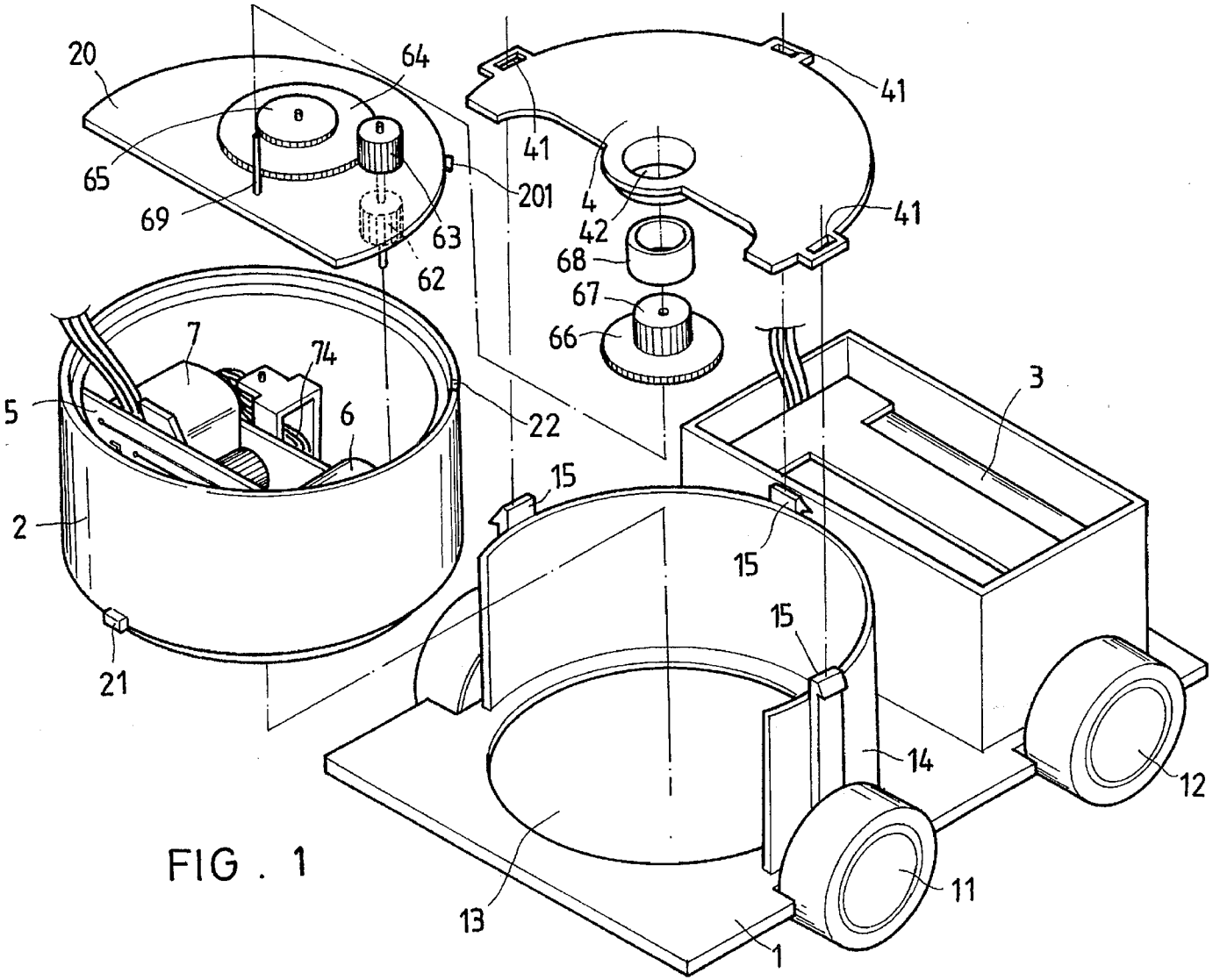
FIG. 1 is an exploded view of the present invention.
Figure 2:
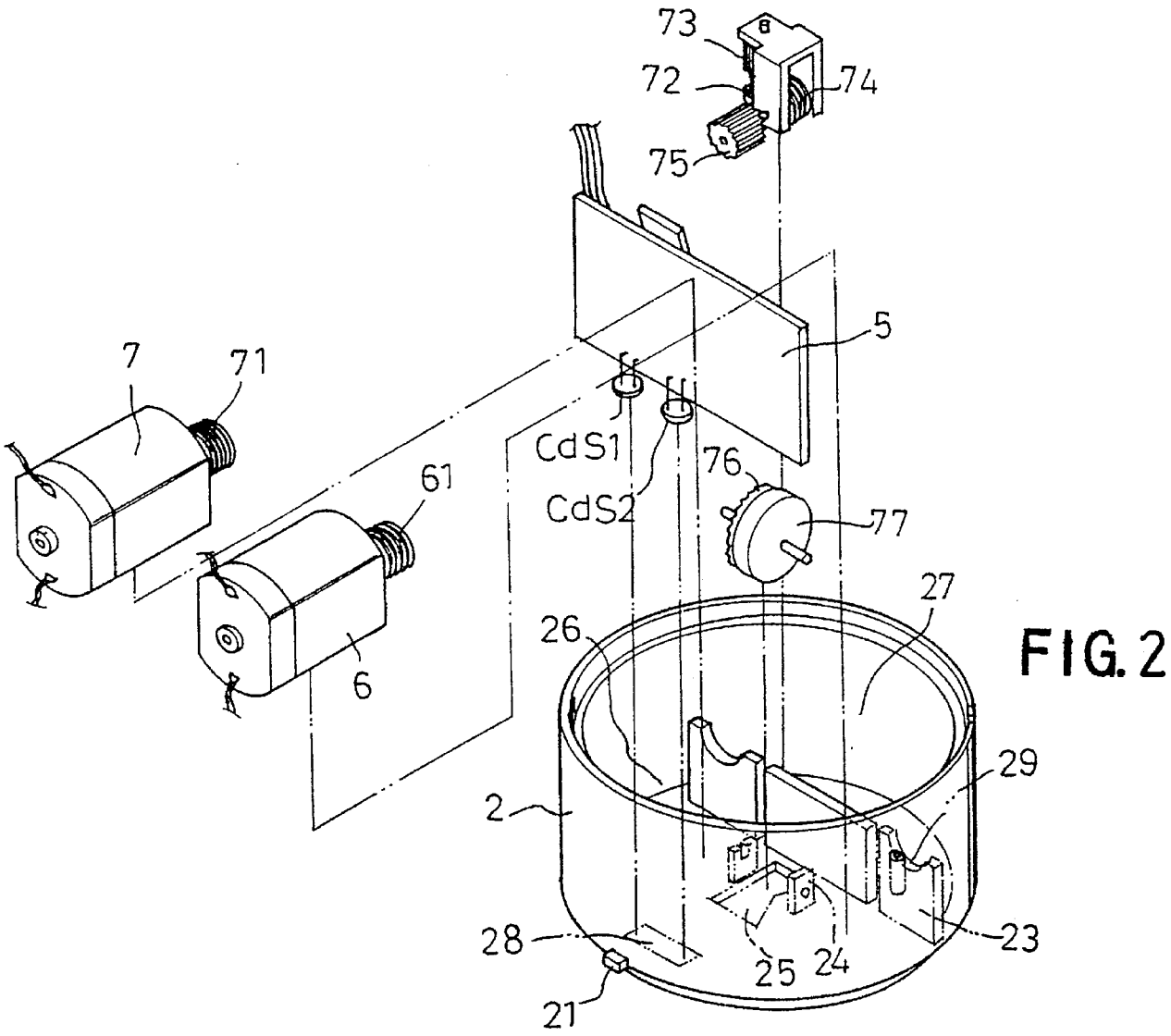
FIG. 2 is an exploded view of the power chamber.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIGS. 1, 2, 3, 4 and 9 thereof, the photosensitive electric toy car according to the present invention mainly comprises a base 1, a power chamber 2, a battery chamber 3, a cover plate 4, a printed circuit board 5, a first motor 6 and a second motor 7.

The base 1 is provided with a pair of front wheels 1 at the front portion and a pair of rear wheels at the rear portion. Further, the base 1 has an opening 13 between the two front wheels 1 and is provided with a curved member 14 concentric with and having a larger diameter than the opening 13. The curved member 14 has a plurality of hook portions 15 at the upper edge.

Figure 3:
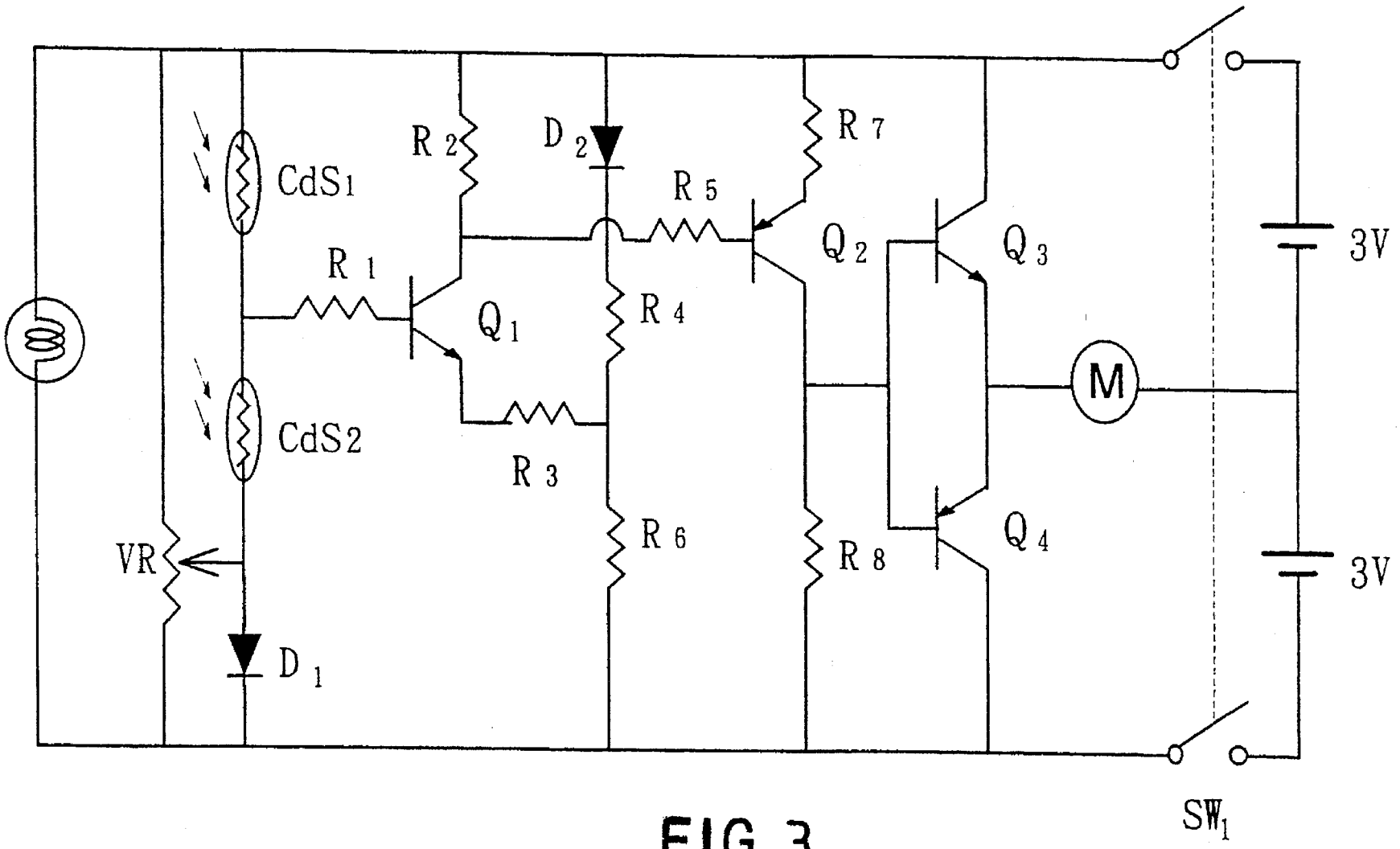
FIG. 3 is a circuit diagram of the present invention.
Figure 4:
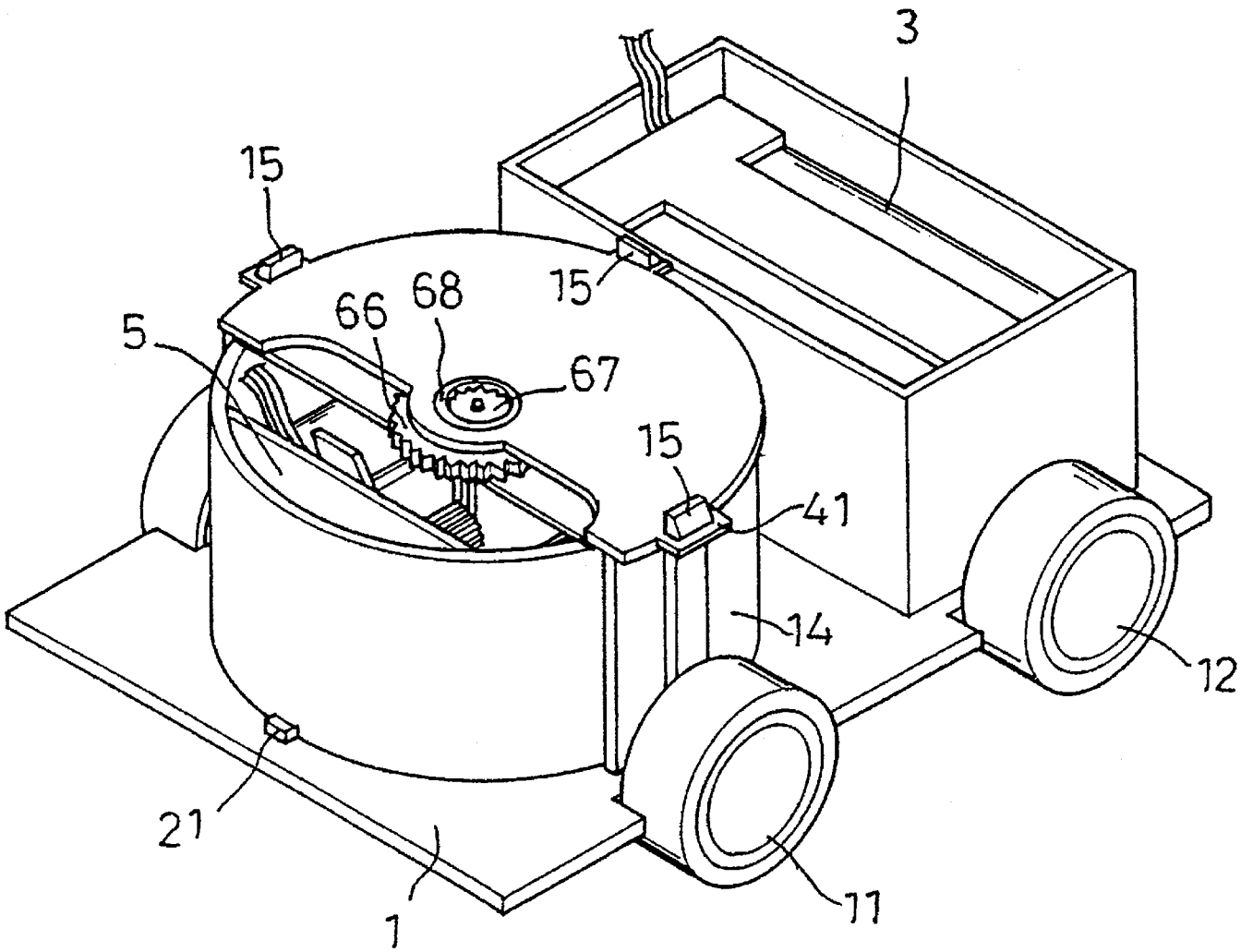
FIG. 4 is a perspective view of the present invention, with the housing removed.
Figure 5A:
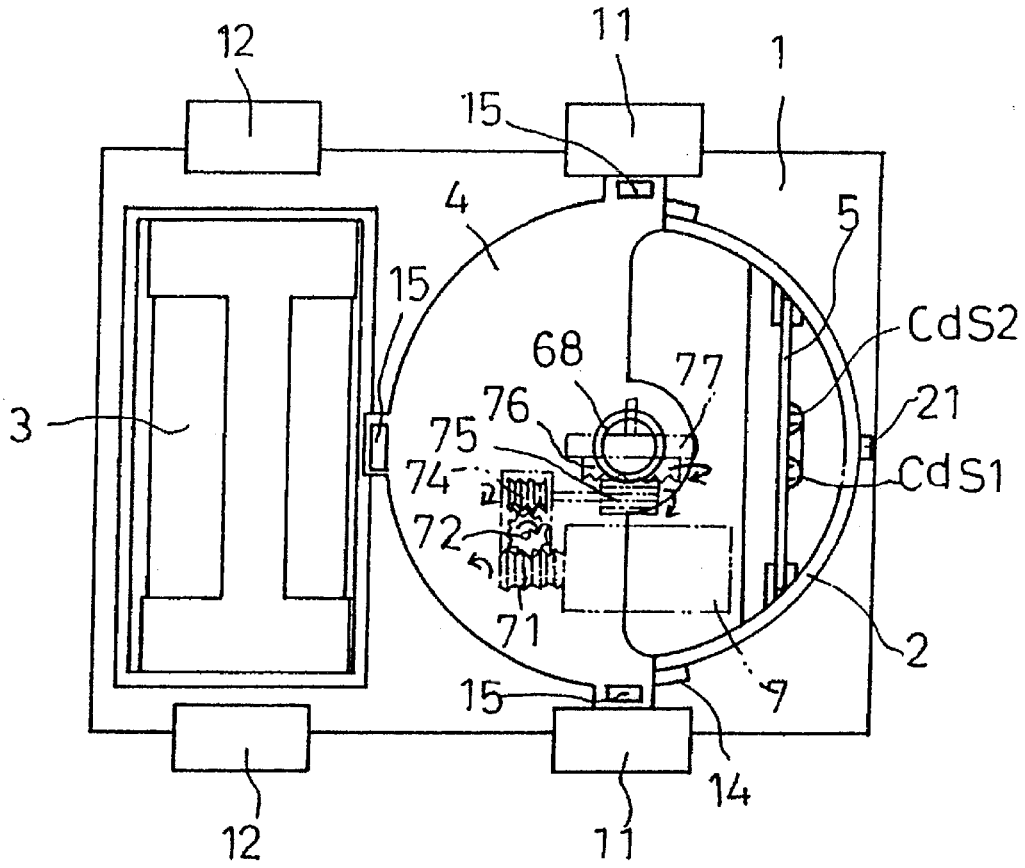
FIGS. 5A and 5B illustrate the driving structure of the present invention.
Figure 5B:
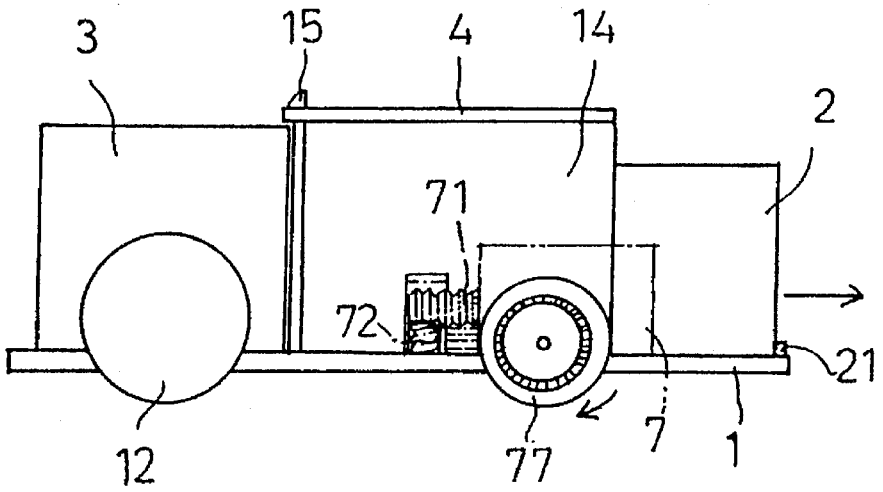
Figure 6A:
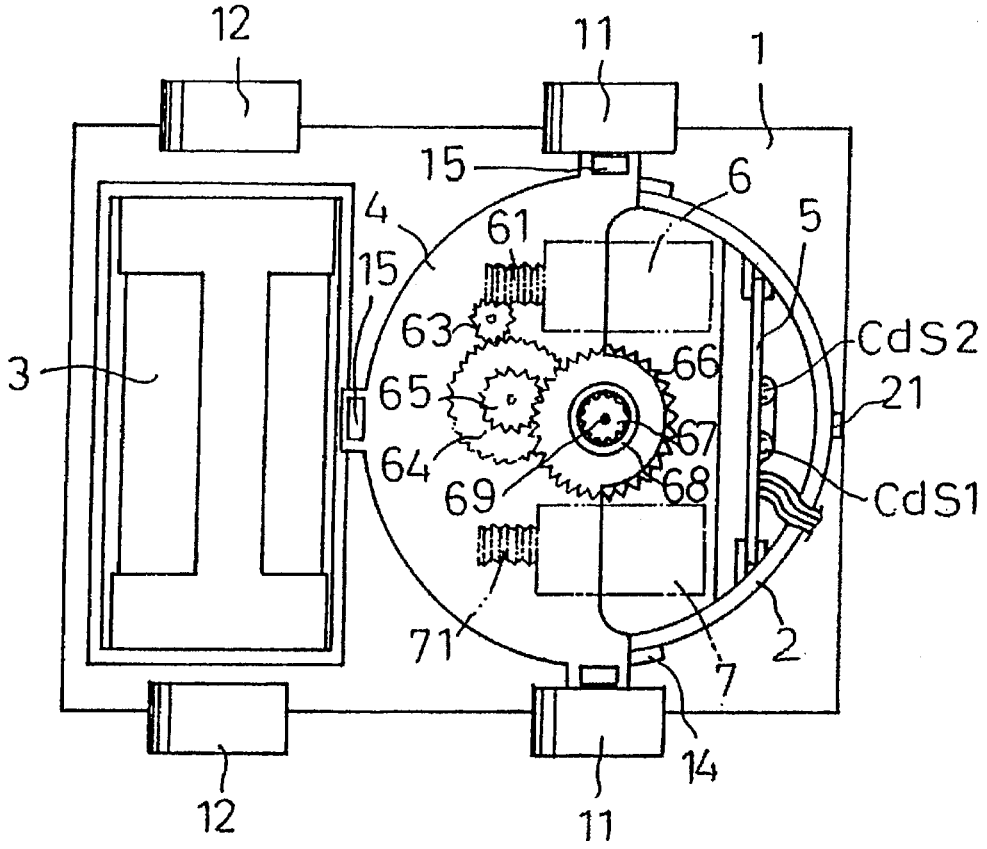
FIGS. 6A and 6B illustrate the direction controlling structure of the present invention.
Figure 6B:
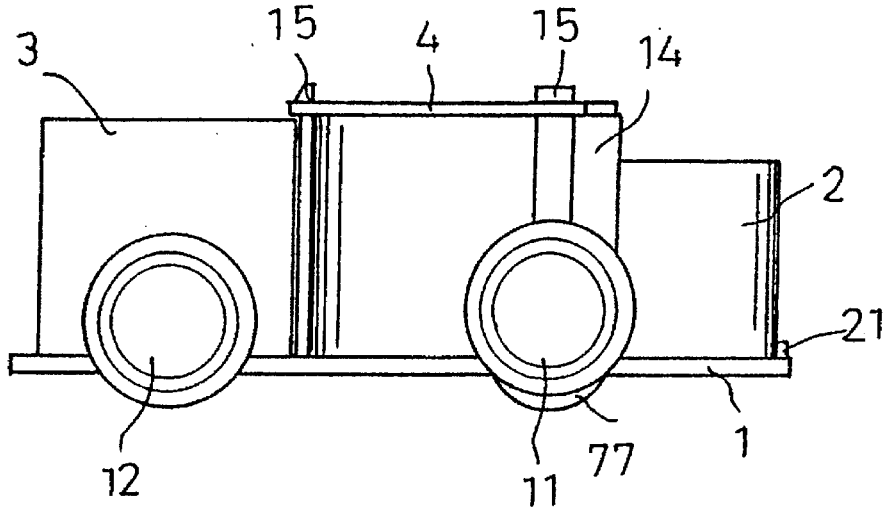
Figure 7A:
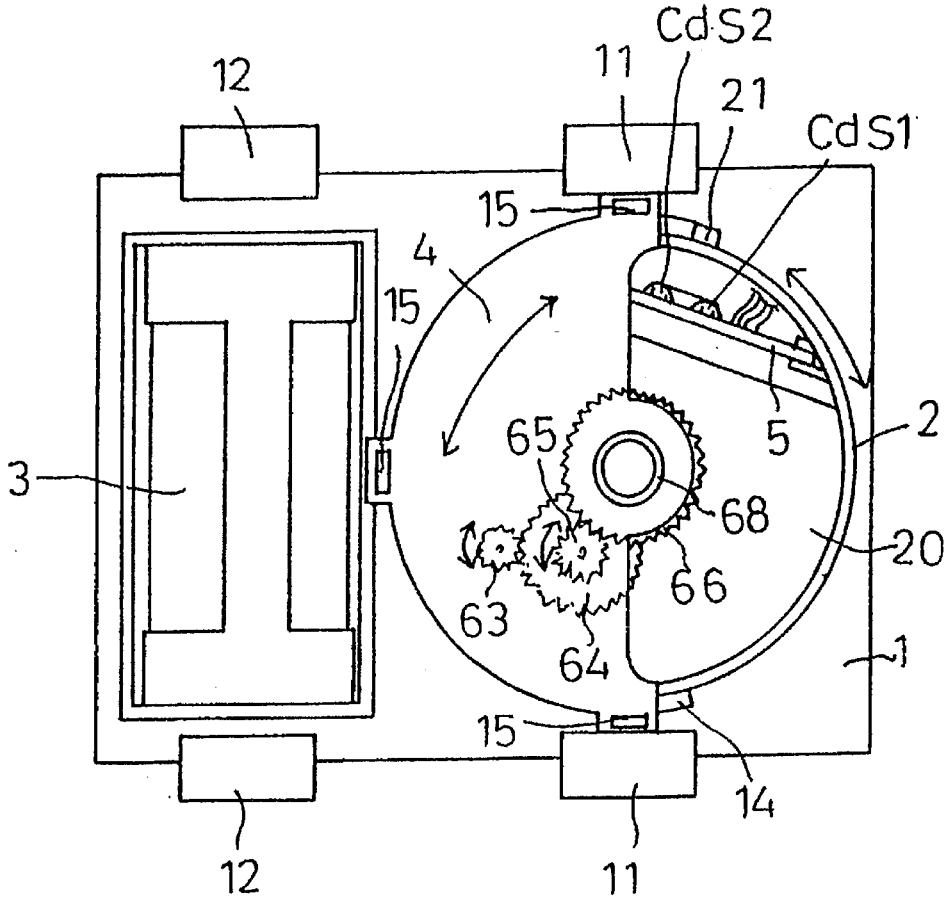
FIGS. 7A and 7B illustrate the working principle of the direction controlling structure of the present invention.
Figure 7B:
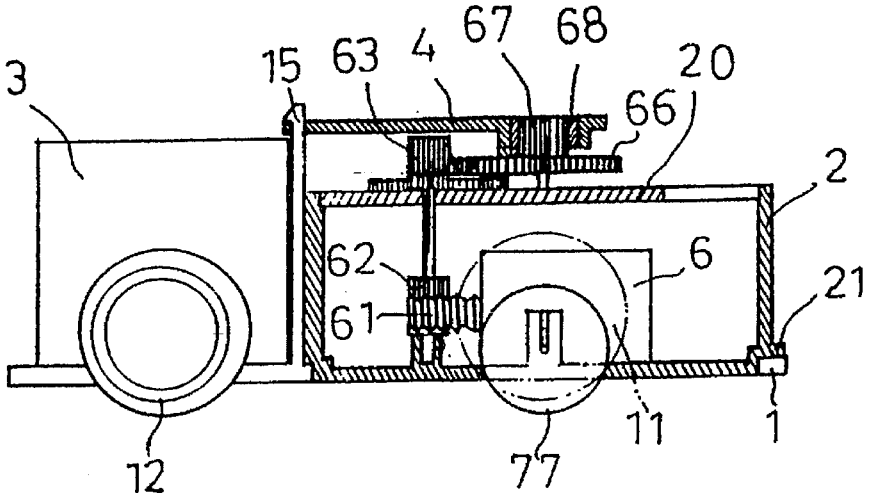

Referring to FIGS. 1, 2, 6A, 6B, 7A and 7B, the power chamber 2 is a cylindrical housing with a protuberance 21 at the outer side and a slot 22 at the upper edge. The power chamber 2 is fitted on the opening 13 and has an outer diameter which is just equal to the inner diameter of the curved member 14. On the inner bottom of the power chamber 2 there is a partition 23 which divides the power chamber 2 into a control room 26 and a transmission room 27. The control room 26 includes a slot 28 and an opening 25 at the bottom, while the transmission room 27 has a vertical tubular portion 29. The opening 25 has two lugs 24 one at a side thereof. A driven plate 20 having a projection 201 at the edge is arranged on the top of the power chamber 2 with the projection 201 engaged with the slot 22. On the driven plate 20 there are rotatably mounted a gear 64, a gear 65 coaxial with the gear 64, and a gear 63 meshed with the gear 64. The cover plate 4 has three lugs 41 at the circumference and a hole 42 at the center. The cover plate 4 is fitted on the top of the curved member 14, with the lugs 41 engaged with the hook portions 15. A ferrule 68 is fitted into the hole 42 of the cover plate 4. A gear 67 is installed into the ferrule 68. A gear 66 is coaxially mounted under the gear 67. As the cover plate 4 is mounted on the curved member 14, the gear 64 is meshed with the gear 66. The gear 63 is provided with an axle extending downwardly into the power chamber 2 to engage with a worm gear 62. The first motor 6 is arranged within the power chamber 2 and provided with an output worm rod 61 which is meshed with the worm gear 62. The printed circuit board 5 is fitted within the control room 26 of the power chamber 2 and is provided with a control means as shown in FIG. 3. The control means may be of any conventional design well known to those skilled in the art and is not considered a part of the invention. As illustrated in FIG. 3, the signal picked up by two photosensitive resistors CdS1 and CdS2 is connected to an amplifier and a complimentary-symmetry circuit to control the rotating direction of the motor 6. The signal is obtained from the light reflected by the ground from an electric light bulb. As the photosensitive resistors CdS1 and CdS2 pick up a signal, the motor 6 will be controlled to rotate in a certain direction. Then, the output worm rod 61 will drive the worm gear which in turn will drive the gear 63. In the meantime, the gear 63 will drive the gear 64 which in turn will drive the gear 65. As the gear 65 is meshed with the gear 66 which is fixedly mounted on the cover plate 4, the power chamber 2 will be rotated with respect to the cover plate 4 thereby making the toy car to take a turn. The protuberance 21 of the power chamber 2 is used for limiting the angle that the power chamber 2 could be rotated through.

The battery chamber 3 is installed between the two rear wheels 12 and electrically connected with the printed circuit board 5.

As shown in FIGS. 1, 2, 5A and 5B, the means for driving the present invention includes a second motor 7 mounted within the control room 26 and provided an output worm rod 71, a worm gear 72 meshed with the output worm rod 71, a worm gear 73 coaxial with the worm gear 72, a worm rod 74 meshed with the worm gear 73, a gear coaxial with third worm rod 74, and a circular toothed wheel 77 having teeth 76 engaged with the gear 75. The circular toothed wheel 77 is pivotally mounted between the two lugs 24 and partially protrudes out of the base 1 through the opening 25 to contact with the ground, so that when the circular toothed wheel 77 is rotated, the toy car according to the present invention will be driven to go forward. The motor 7 is also electrically connected with the control means on the printed circuit board 5.

Figure 8:
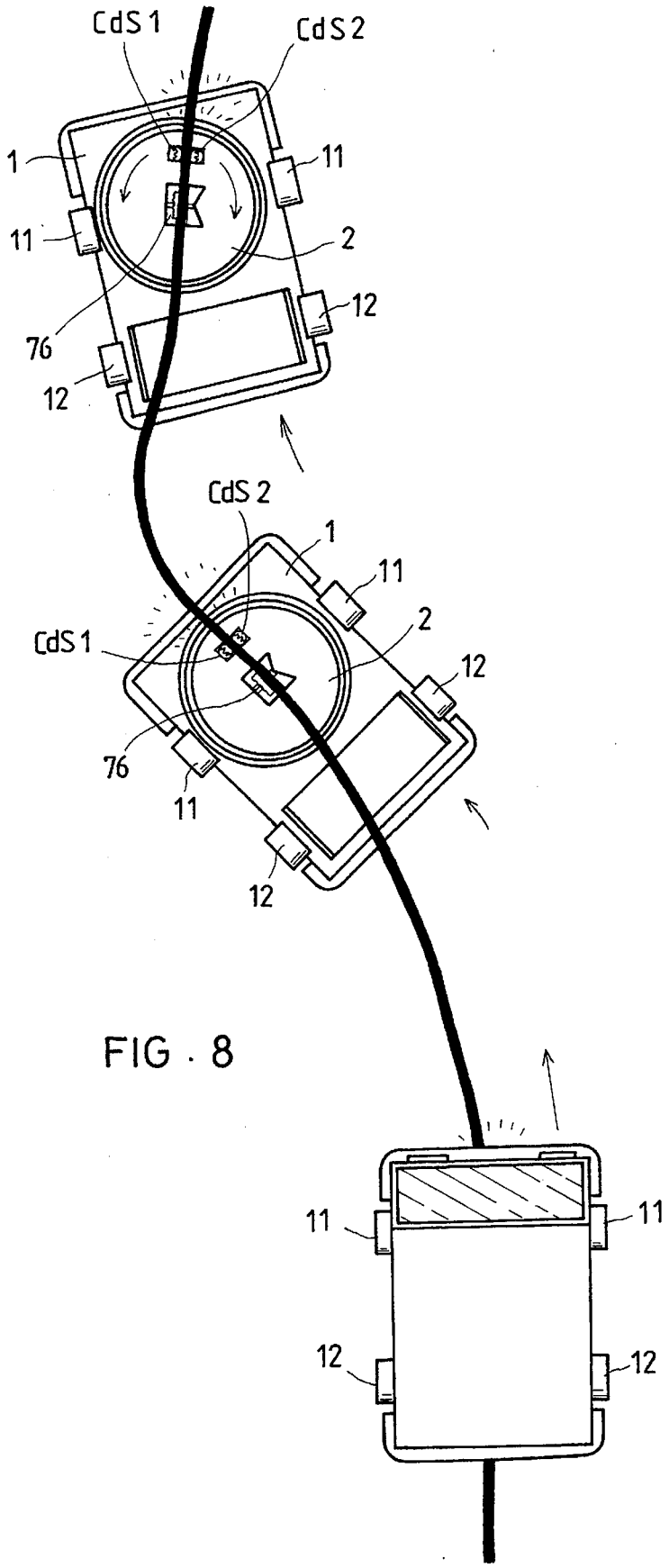
FIG. 8 illustrates how to use a light absorbing cable to guide the present invention.
Figure 9:
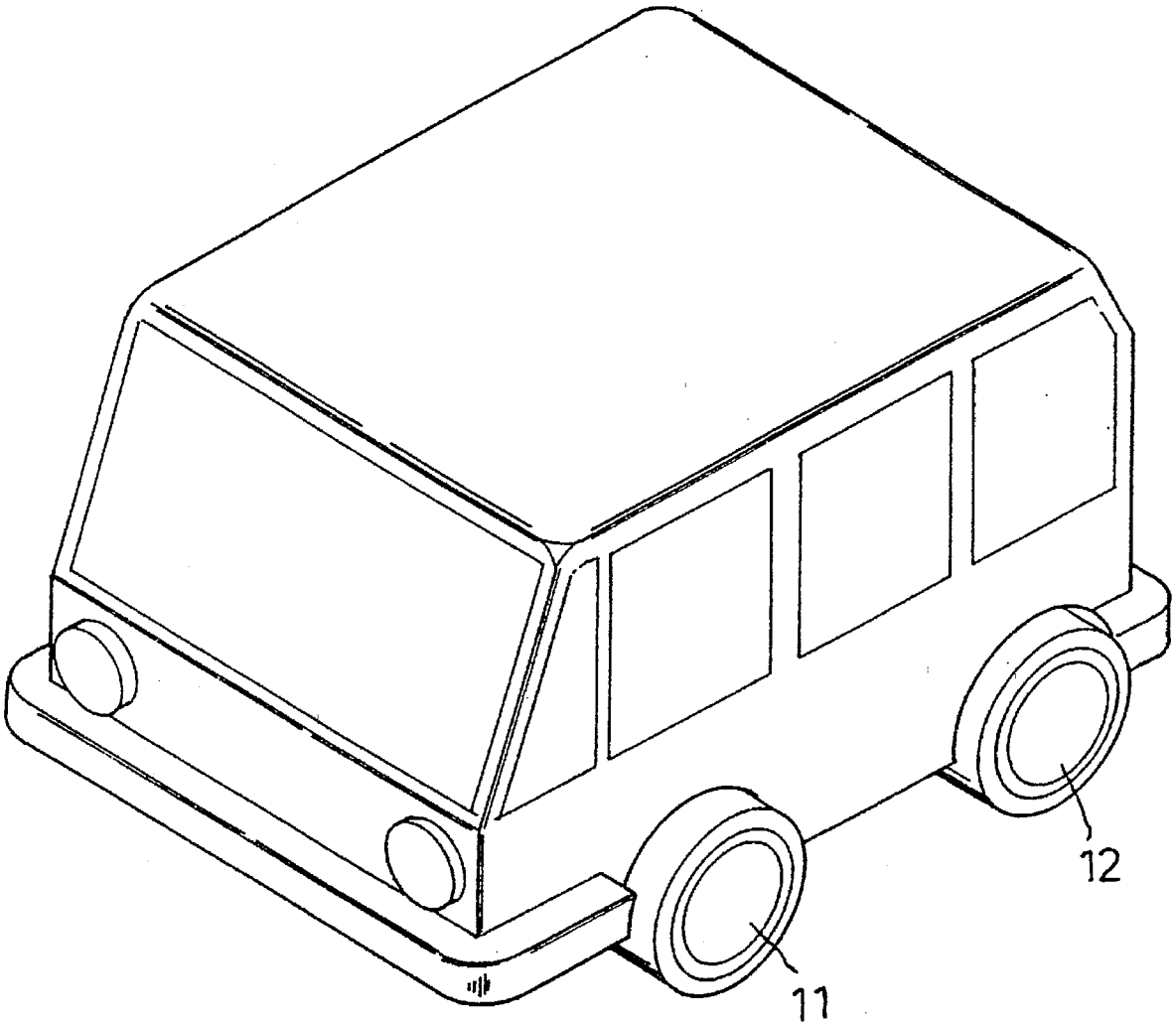
FIG. 9 is a perspective view of the present invention.

Furthermore, a light absorbing cable may be placed on the ground as desired so that the toy car can be controlled to travel therealong (see FIG. 8).

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A photosensitive electric toy car comprising:

a base provided with a pair of front wheels at a front portion thereof, a pair of rear wheels at a rear portion thereof, an opening between said front wheels, and a curved member on said base concentric with and having a larger diameter than said opening;

a power chamber fitted on said opening and having a partition dividing said power chamber into a control room and a transmission room, said control room being provided on a bottom thereof with two lugs, an opening between said two lugs, and a slot opposite to said opening;

a printed circuit board fitted within said control room and having a control means provided two photosensitive resistors which will pick up signal from ground to control rotating direction of a first motor, said first motor having a first output worm rod;

a battery chamber electrically connected with said control means;

a driven plate mounted on a top of said power chamber and provided with a first gear, a second gear coaxially mounted on said first gear, a third gear meshed with said first gear, and an axle having an upper end engaged with said third gear and a lower end with a first worm gear meshed with said first output worm rod;

a cover plate mounted on a top of said curved member and having a hole, a ferrule fitted into said hole, a fourth gear fitted into said ferrule, and a fifth gear coaxially mounted under said fourth gear, said fourth gear being meshed with said second gear; and a driving means including a second motor mounted within said control room and provided with a second output worm rod meshed with a second worm gear, a third worm gear coaxial with said second worm gear, a third worm rod meshed with said third worm gear, a sixth gear coaxial with said third worm rod, and a circular toothed wheel engaged with said sixth gear, said circular toothed wheel being pivotally mounted between said two lugs and partially protruding out of said base through said opening, said second motor being electrically connected with said control means.

* * * * *